US006471728B2

(12) United States Patent
Smith et al.

(10) Patent No.: US 6,471,728 B2
(45) **Date of Patent: *Oct. 29, 2002**

(54) REMOVAL OF BLOOD STAINS

(75) Inventors: Kim R. Smith, Woodbury, MN (US); Lynne Ann Olson, Ellsworth, WI (US)

(73) Assignee: Ecolab Incorporated, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 36 days.

(21) Appl. No.: 09/079,793

(22) Filed: May 15, 1998

(65) Prior Publication Data

US 2001/0014656 A1 Aug. 16, 2001

(51) Int. Cl.[7] ..... D06L 1/00; C11D 3/26; C11D 7/32

(52) U.S. Cl. ..... 8/137; 134/42; 510/277; 510/281; 510/300; 510/321; 510/337; 510/350; 510/351; 510/361; 510/393; 510/421; 510/426; 510/433; 510/434; 510/466; 510/488; 510/530

(58) Field of Search ..... 510/276–277, 510/281, 299–300, 320–321, 337, 350–351, 361, 392–393, 405, 421, 426, 433–434, 466, 488, 530; 134/42; 8/137

(56) References Cited

U.S. PATENT DOCUMENTS

| | | | | | |
|---|---|---|---|---|---|
| 3,494,870 | A | | 2/1970 | Kersnar et al. | 510/281 |
| 3,935,129 | A | | 1/1976 | Jabalee | 252/525 |
| 4,048,121 | A | | 9/1977 | Chang | 252/527 |
| 4,202,800 | A | | 5/1980 | Ciko et al. | 252/543 |
| 4,261,868 | A | * | 4/1981 | Hora et al. | 510/393 |
| 5,474,698 | A | * | 12/1995 | Rolando et al. | 252/90 |
| 5,484,555 | A | * | 1/1996 | Schepers | 8/137 |
| 5,565,006 | A | * | 10/1996 | Videbaek et al. | 510/320 X |
| 5,707,948 | A | | 1/1998 | Evers et al. | 510/217 |
| 5,739,095 | A | * | 4/1998 | Langguth et al. | 510/367 |
| 5,871,550 | A | * | 2/1999 | Goedegebuur et al. | 8/137 |
| 5,932,527 | A | | 8/1999 | Roselle et al. | 510/111 |
| 5,958,854 | A | | 9/1999 | Laing et al. | 510/218 |
| 5,958,871 | A | | 9/1999 | Clare | 510/507 |
| 5,965,507 | A | * | 10/1999 | Thoen et al. | 510/320 |

FOREIGN PATENT DOCUMENTS

| | | | |
|---|---|---|---|
| DE | 3344097 | | 6/1984 |
| EP | 0 114 113 | | 7/1984 |
| EP | 383373 | A2 * | 8/1990 |
| GB | 2042580 | A * | 2/1980 |
| GB | 2 131 826 | A | 6/1984 |
| GB | 2 137 882 | A | 10/1984 |
| JP | 52-126408 | | 10/1977 |
| WO | WO 97/03155 | | 1/1997 |

OTHER PUBLICATIONS

Neher, D. et al, "Interaction between blood and oxygenating bleaching agents and problems involving enzyme–containing washing agents", Fette, Seifen, Anstrichm. 72(3):192–9 (abstract only), 1970.*

Oldenroth, O., "Action of enzymic prewashing agents", Fette, Seifen, Anstrichm. 70(1). 24–9 (abstract only), 1968.*

Liss, R. L. et al., "Enzymes in detergents", *J. Amer. Oil Chem. Soc.* (Mar. 4, 1969), 46(10):507–510.

Vaeck, S. V. et al., "A micro wash test for the determination of enxyme performance", *Fette, Seifen, Anstrichm.* (Jul. 1970), 72(7):573–9.

* cited by examiner

*Primary Examiner*—Yogendra N. Gupta
*Assistant Examiner*—Brian P. Mruk
(74) *Attorney, Agent, or Firm*—Merchant & Gould P.C.

(57) ABSTRACT

A blood removing cleaning composition which may take the form of a detergent builder, detergent additive, or detergent pre-spotter, generally including an amount of amine compound effective to remove blood from fabric; and, optionally, an effective soil degrading amount of enzyme, wherein the composition is generally free of any neutral salt. In other preferred forms, the compositions disclosed herein may comprise surfactants, sources of alkalinity, and sequestrants, among other adjuvants.

21 Claims, No Drawings

REMOVAL OF BLOOD STAINS

FIELD OF THE INVENTION

The invention relates to compositions and methods for removal of blood stains from fabrics. More specifically, the invention relates to amine-based compositions and methods of using these compositions for the removal of blood stains from textiles including natural and synthetic fabrics.

BACKGROUND OF THE INVENTION

The routine soiling of clothing, uniforms, and coverings is common in many industries. In most instances, fabrics soiled in the course of professional service can be laundered, effectively returning the fabric to a condition suitable for use. As one might suspect, certain types of soils are more difficult to remove from fabric than others.

Soiling resulting from contact with mammalian blood can be some of the most resistant to laundering. Blood is generally considered a fluid connective tissue comprising plasma and cells which circulates within vessels in mammalian bodies. Of the many constituents of mammalian blood, certain elements such as, for example, hemoglobin and iron may contribute to the difficulty in removing blood stains from fabrics. As the blood dries on the fabric, it becomes a hydrophobic, protein-based soil that forms a crusty surface that is difficult to disrupt.

In the past, uniforms, aprons and other fabrics, soiled with blood, were laundered in a highly alkaline solution. However, the use of these caustic solutions requires the application of a large volume of rinse water to avoid deterioration of the fabric and burning any person who may come into contact with the fabric. In turn, the rinse water resulting from laundering creates environmental concerns as the water must be neutralized and disposed.

One alternative to using a caustic laundry wash may be found in Japanese Kokai Patent Appellation No. Sho 52 [1977]-126408 to Kawabe. Kawabe discloses the use of a dilute combination, of hexylene glycol to increase osmotic capacity, monethanolamine to chelate iron in hemoglobin, and sodium chloride to displace iron in hemoglobin for blood removal. However, the use of sodium chloride is disadvantageous in two respects. First, the sodium chloride requires the incorporation of substantial water to solubilize the salt. Further, this also prevents the formulation of highly concentrated detergents sought by the laundry industry. Second, in the laundry environment, sodium chloride can also lead to metal stress and fatigue, ultimately resulting in corrosion.

As a result, there is still a need for laundry compositions and laundering methods which effectively remove blood stains from fabrics while not causing deterioration of the machines used in the process.

SUMMARY OF THE INVENTION

In accordance with a first aspect of the invention, there is provided a method of removing blood stains from fabric, comprising the step of applying a cleaning composition to the fabric. The cleaning composition comprises a detergent additive, comprising from about 95 to 99.9 wt-% of an amine compound, and from about 0.1 to 5 wt-% of an enzyme compound wherein the composition is free of neutral salts such as sodium chloride.

In accordance with a further aspect of the invention, there is provided a detergent additive composition comprising an amount of amine compound effective to remove blood from fabric; and an effective soil degrading amount of enzyme, wherein the detergent additive composition is solvent-free and free of any neutral salt.

In accordance with a second aspect of the invention, there is provided a detergent builder comprising an effective blood removing amount of amine compound; an effective amount of chelating agent; an amount of alkalinity source effective to provide a compositional pH of from about 8 to 14; and a balance of water.

In accordance with another aspect of the invention, there is provided a method of removing blood stains from fabric, comprising the step of applying a cleaning composition to the fabric. The cleaning composition comprises a detergent builder comprising an effective blood removing amount of amine compound, an effective amount of chelating agent, an amount of alkalinity source effective to provide a compositional pH in the detergent builder of from about 8 to 14, and a balance of water.

In accordance with a third aspect of the invention, there is provided a laundry pre-spotter composition and methods of using the same for removal of blood stains from fabric. The composition comprises an amount of surfactant effective to provide detersive action to the composition; a blood stain removing effective amount of amine compound; and a balance of water wherein the composition is free of any neutral salt.

The invention has various aspects which allow removal of blood stains from natural and synthetic fabrics. The invention allows removal of blood stains from fabrics without the use of neutral salts such as sodium chloride to displace the iron compound found in the blood hemoglobin. Further, the compositions and methods of the invention do not require the use of osmosis enhancing agents such as alkylene glycols.

Representative fabrics which may be treated by the compositions and methods of the invention include those derived from natural and synthetic fibers including celluloses, acrylics, olefins, acetates, aramids, nylons, polyesters, segmented polyurethanes (spandex), regenerated proteins (azlon), polyphenylene sulfides, and carbon/graphite fibers as well as inorganic fibers based on glass, metal, or ceramic constituents.

We have discovered that water-soluble amines can be formulated to be a very effective means of removing blood stains from fabric without the need for the alkylene glycol or neutral salt adjuvants of Kawabe or for active oxygen bleaches or active chlorine bleaches. These amines are not only more effective than the prior art but are also free of the chemical stability problems seen with active oxygen and chlorine bleaches. Additionally, the amines are not limited to only white fabrics as seen with active chlorine bleaches. In the context of this invention, a neutral salt is an inorganic salt which, when dissolved in an aqueous system, does not substantially affect the pH of the system.

Water-soluble amines may be described by the appropriate combination of the general structure $R_1R_2R_3N$ such that water solubility is greater than 1% where $R_1$, $R_2$, and $R_3$ can be hydrogen, alkyl, hydroxyallkyl, poly(alkoxy)alkyl, ester-substituted alkyl, or amide-substituted alkly substituents. The preferred type of water-soluble amines for this invention can be described as alkanolamines, a more preferred type as ethanolamines, and most preferred as diethanolamine.

These amines may be used alone or incorporated into fabric pre-spotters, laundry detergents, builders, or dry cleaning detergents. Except for the incorporation of the amines disclosed herein, such formulations are well-known to those versed in the fabric care art.

DETAILED DESCRIPTION OF THE PREFERRED EMBODIMENTS

The invention comprises compositions and methods for removing blood stains from natural and synthetic fabrics. Included in the invention are detergent additives, detergent pre-spotters, and detergent builders. The constituents of these systems may include one or more amine compounds, enzymes, chelating agents, as well as additional surfactants and sources of alkalinity.

The Amine Compound

The compositions of the invention generally comprise one or more organic alkali compounds. Useful organic alkalis include amine compounds which function to swell blood cells and thereby facilitate removal of the stain from fabric.

Representative amine compounds suitable include alkyl amines such as methylamine, dimethylamine, ethylamine, diethylamine, n-propylamine, di-n-propylamine, isopropylamine, disopropylamine, n-butylamine, di-n-butylamine, isobutylamine, diisobutylamine, sec-butylamine, t-butylamine, ethyl-n-butylamine, dimethyl-n-butylamine, n-amylamine, and di-n-amylamine; cycloaliphatic amines such as 1-methylcyclohexylamine, 2-methylcyclohexylamine, 3-methylcyclohexylamine, 4-methylcyclohexylamine,3,3,5-trimethylcyclohexylamine, 4-tert-butylcyclohexylamine, N-methylcyclohexylamine, N-ethylcyclohexylamine, N,N-dimethylcyclohexylamine, N,N-diethylcyclohexylamine, dicyclohexylamine; and diamines such as ethylenediamine, propylene diamine, butylene diamine, and pentylene diamine; and mixtures thereof.

Preferred amines generally include mono-, di-, and tri-alkanol amines such as ethanol amine, propanol amine, butanol amine, diethanolamine, dipropanolamine, triethanol amine, and mixtures thereof In particular, we have found that diethanol amine provides heightened efficacy in removal of blood stains from synthetic and natural fibers.

The Enzyme Compounds

The invention may also comprise one or more enzymes. Generally, depending on the application, the composition may comprise enzymes capable of hydrolyzing proteins, (proteases), enzymes capable of hydrolyzing starch (amylases), enzymes capable of hydrolyzing fibers (cellulases), enzymes which are capable of hydrolyzing fats and oils (lipases/phospholipases), enzymes that reduce or oxidize molecules (redox enzymes), or enzymes that rearrange molecules (isomerases).

Preferred enzymes for use in compositions of the invention include proteases. Proteases are enzymes that hydrolyze peptide bonds in protein. The basic building blocks of protein polymers are amino acids. Amino acids can be joined to form peptide chains. The linkage between each amino acid is called a peptide bond. Proteases split peptide bonds with water by one of two modes. Exoproteases cleave off single amino acids from either end of a peptide chain. Endoproteases attack the interior peptide bonds of a protein chain. The hydrolysis products of such a mode of attack are usually the smaller polypeptides and peptides.

In the context of this invention, any protease may be used which functions to break down the constituents of blood present in the stained fabric.

Depending upon the application, any number of other enzymes may be used in the compositions of the invention. Notably, in laundry washing and care compositions, cellulases generally are used to hydrolyze fibers and prevent common pilling which often occurs after extended washings. In warewashing compositions, enzymes such as amylases are used to assist in solubilizing proteinaceous soils. Generally, depending on the ultimate application and other constituents which may be present in the composition, the composition should be monitored to ensure proper pH as well as to prevent the inadvertent combination of the enzyme source with constituents which may compromise its effectiveness such as bleaches.

Chelating Agents

In order to prevent the formation of precipitates or other salts, the composition of the invention may generally comprise builders, chelating agents or sequestrants.

Generally, sequestrants are those molecules capable of coordinating the metal ions commonly found in service water and thereby preventing the metal ions from interfering with the functioning of detersive components within the composition. The number of covalent bonds capable of being formed by a sequestrant upon a single hardness ion is reflected by labeling the sequestrant as bidentate (2), tridentate (3), tetradentate (4), etc. Any number of sequestrants may be used in accordance with the invention. Representative sequestrants include salts of amino carboxylic acids, phosphonic acid salts, and water soluble acrylic polymers, among others.

Suitable amino carboxylic acid chelating agents include n-hydroxyethyliminodiacetic acid, nitrilotriacetic acid (NTA), ethylenediaminetetraacetic acid (EDTA), hydroxyethyl-ethylenediaminetriacetic acid (HEDTA), and diethylenetriaminepentaacetic acid (DTPA). When used, these amino carboxylic acids are generally present in concentrations ranging from about 1 wt-% to 50 wt-%, preferably from about 5 wt-% to 30 wt-%, and most preferably from about 5 wt-% to 20 wt-%.

Other suitable sequestrants include water soluble acrylic polymer to condition the wash solutions under end use conditions. Such polymers include polyacrylic acid, polymethacrylic acid, acrylic acid-methacrylic acid copolymer, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as these respective alkali metal (for example, sodium or potassium) or ammonium salts can also be used.

The weight average molecular weight ($M_w$) of the polymers is from about 4000 to about 12000. Preferred polymers include polyacrylic acid, the partial sodium salts of polyacrylic acid or sodium polyacrylate having an average molecular weight within the range of 4000 to 8000. These acrylic polymers are generally useful in concentrations ranging from about 0.1 wt-% to 10 wt-%, preferably from about 1 wt-% to 5 wt-%, and most preferably from about 1 wt-% to 2 wt-%.

Also useful as sequestrants are phosphonic acids and phosphonic acid salts. In addition to conditioning the water, organic phosphonic acids and phosphonic acid salts provide a grease dispersing character. Such useful phosphonic acids include mono, di, tri and tetra-phosphonic acids which can also contain groups capable of forming anions under alkaline conditions such as carboxy, hydroxy, thio and the like. Among these are phosphonic acids having the formula $R_1N[CH_2PO_3H_2]_2$ or $R_2C(PO_3H_2)_2OH$ wherein $R_1$ may be -[(lower) alkylene]$N[CH_2PO_3H_2]_2$ or a third $[CH_2PO_3H_2]$ moiety; and wherein $R_2$ is selected from the group consisting of $C_1$–$C_6$ alkyl.

The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid.

When used as a sequestrant in the invention, phosphonic acids or salts are present in a concentration ranging from about 0.1 wt-% to 10 wt-%, preferably from about 1 wt-% to 5 wt-%, and most preferably from about 1 wt-% to 2 wt-%.

Surfactants

The use of nonionic surfactants in the compositions of the invention loosens staining material from fabric and enhances the transfer of this material into the cleaning system so that this material may be washed away. Nonionics useful in this invention include alkyl phenol ethoxylates, dialkylphenol ethoxylates, alcohol ethoxylates, and ethylene oxide/propylene oxide block copolymers such as the PLURONIC™ surfactants commercially available from BASF Wyandotte, glycol esters, polyethylene glycol esters, sorbitan esters, polyoxyethylene sorbitan esters, sucrose esters, glycerol esters, polyglycerol esters, polyoxyethylene glycerol esters, polyoxyethylene ethers, alkylpolyglucosides.

Nonionic surfactants which have generally been found useful in the invention are those which comprise ethylene oxide moieties, propylene oxide moieties, as well as mixtures thereof, and ethylene oxide-propylene oxide moieties in either hetero or block formation. Additionally useful in the invention are nonionic surfactants which comprise alkyl ethylene oxide compounds, alkyl propylene oxide compounds, as well as mixtures thereof, and alkyl ethylene oxide propylene oxide compounds where the ethylene oxide-propylene oxide compounds where the ethylene oxide propylene oxide moiety is either in heteric or block formation. Further useful nonionic surfactants are those having any mixture or combination of ethylene oxide-propylene oxide moieties linked to an alkyl chain where the ethylene oxide and propylene oxide moieties may be in any randomized or ordered pattern and of any specific length. Nonionic surfactants useful in the composition of the invention may also comprise randomized sections of block and heteric ethylene oxide propylene oxide, or ethylene oxide-propylene oxide.

Also useful are alkyl polyglycoside surfactants such as octyl polyglycoside (1.5 DP), decyl polyglycoside (1.50 DP), as well as lauryl/myristyl polyglycosides such as those available from Henkel under the Glucopan tradenames (200 and 660, respectively). Generally, this class of ionic surfactants has a structure of:

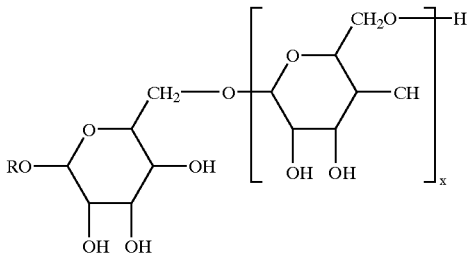

wherein R is $C_8$ through $C_{24}$ alkyl and DP=X and is between 1 and 10.

Two specific types of nonionic surfactants have been found to be preferable in the compositions of the invention. First, polyoxypropylene-polyoxyethylene block polymers having a molecular weight of at least 1900 have been found to be especially useful in the invention. These polymers generally have the formula:

$$HO(CH_2CH_2O)_x—(CH(CH_3)CH_2O)_y—(CH_2CH_2O)_2H$$

in which the average x=0–150, preferably, 2–128, y=0–150, and preferably, 16–70, and z=0–150, and preferably, 2–128.

More preferably, the polyoxypropylene-polyoxylthylene copolymers used in the invention have an x=2–40, a y=30–70 and a z=2–40.

A second class of nonionic surfactants which is useful in the present invention and desirable for other applications are alcohol ethoxylates. Such nonionics are formed by reacting an alcoholate salt ($RO—Na^+$) wherein R is an alcohol or alkyl aromatic moiety with an alkylene oxide. Generally, preferred alkoxylates are $C_{1-12}$ alkyl phenol alkoxylates such as the nonyl phenol ethoxylate which generally have the formula:

$$C_9H_{19}C_6H_4(OCH_2CH_2)_nOH$$

where n may range in value from 6 to 100.

Nonyl phenol ethoxylates having an ethoxylate molar value ranging from about 6 moles to 15 moles have been found preferable for reasons of low foaming character.

Preferred surfactants include nonionic alcohol ethoxylates having about 3 to 9 moles of ethoxylation such as laureth/myristeth-7 commercially available from Huntsman Chemical.

Sources of Alkalinity

In order to provide an alkaline pH, the composition may comprise an alkalinity source. The concentration of alkaline agent may vary considerably. However, the compositions of the invention, when aqueous, may have a pH in the range of from about 7 to 14, preferably from about 8 to 12, and most preferably from about 9 to 10.

An alkaline pH increases the efficiency of the chemical breakdown and facilitates the rapid dispersion of the bloody soils. The general character of the alkalinity source is only to those chemical compositions which have a greater solubility. Exemplary alkalinity sources include silicates, hydroxides, and carbonates.

Silicates useful in accordance with this invention include alkali metal ortho, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monohydrate, potassium tetrasilicate, potassium tetrasilicate monohydrate, or mixtures thereof.

Generally, when a silicate compound is used as the alkalinity source in the invention, the concentration of the silicate will range from about 1 wt-% to 50 wt-%, preferably from about 10 wt-% to 30 wt-%, and most preferably from about 10 wt-% to 20 wt-%.

Alkali metal hydroxides have also been found useful as an alkalinity source in the present invention. Alkaline hydroxides are generally exemplified by species such as potassium hydroxide, sodium hydroxide, lithium hydroxide, and the like. Mixtures of these hydroxide species may also be used. When present, the alkaline hydroxide concentration generally ranges from about 1 wt-% to about 50 wt-%, preferably from about 10 wt-% to 30 wt-%, and most preferably from about 10 wt-% to 20 wt-%.

An additional source of alkalinity includes carbonates. Alkaline carbonates which may be used in the invention include alkali and alkali earth metal carbonates, bicarbonates, and sesquicarbonates. When carbonates are used, potassium or sodium carbonates are preferred. When carbonates are used the concentration of these agents generally ranges from about 1 wt-% to 50 wt-%, preferably from about 10 wt-% to 30 wt-%, and most preferably from about 10 wt-% to 20 wt-%.

Concentrations (WT-%)

Any number of the constituents discussed above may be used in the compositions and methods of the invention. Certain concentrations have been provided above for constituents which may have varying efficacy but equivalent function. Provided below is a Summary Table of concentrations for the compositions of the invention.

DETERGENT ADDITIVES*

| | Useful | Preferred | More Preferred |
|---|---|---|---|
| amine compound | 95–99.9 | 98–99.9 | 99.5–99.9 |
| enzyme compound | 0.1–5 | 0.1–2 | 0.1–0.5 |

*Solvent free, i.e., free of organic solvent and water

DETERGENT BUILDER

| | Useful | Preferred | More Preferred |
|---|---|---|---|
| amine compound | 30–70 | 40–60 | 45–55 |
| chelating agent | 1–50 | 5–30 | 5–20 |
| alkalinity source | 1–50 | 10–30 | 10–20 |
| water | 5–50 | 10–40 | 20–30 |
| pH | 8–14 | 8–12 | 9–10 |

PRE-SPOTTER

| | Useful | Preferred | More Preferred |
|---|---|---|---|
| amine compound | 0.1–30 | 1–10 | 0.1–5 |
| surfactant | 0.1–30 | 1–10 | 3–5 |
| water | 60–99.9 | 80–99 | 90–99 |
| pH | 8–14 | 8–12 | 9–10 |

Formulation And Use Of Detergent Compositions

In formulation and use, the compositions of the invention may be used independently, such as the pre-spotter, or combined with detergents as additives or builders. One further aspect of the invention is detergent compositions containing the blood stain removing compositions of the invention. The detergent compositions of the invention may also contain additional detergent components. The precise nature of these additional components, and levels of incorporation thereof will depend on the physical form of the composition, and the precise nature of the washing operation for which it is to be used.

The compositions of the invention may contain one or more additional detergent components selected from additional surfactants, additional bleaches, bleach catalysts, alkalinity systems, builders, organic polymeric compounds, additional enzymes, suds suppressers, lime soap dispersants, soil suspension and anti-redeposition agents and corrosion inhibitors.

As noted above, exemplary compositions include detergent prespotters, builders and additives. The detergent prespotter may be used autonomously without mixing in a detergent. Similarly, the detergent builder may be used without pre-mixing the builder in the detergent. The builder is mixed with the detergent upon application, in the cleaning system.

Generally, in use, the concentration ratio of builder to detergent may range from about 4:1 to 1:4, preferably from about 3:1 to 1:3, and more preferably from about 2:1 to 1:2. The detergent additive may be mixed with a detergent prior to use or during the wash operation. Generally, the concentration ratio of detergent additive to detergent ranges from about 4:1 to 1:4, preferably 3:1 to 1:3, and more preferably from about 2:1 to 1:2.

For both a pre-spotter and the detergent additive, the preferred composition may contain sufficient water-soluble amine to effectively remove blood from fabric; 0.1–5% more preferred for a pre-spotter and 99.5–99.9% more preferred for a laundry detergent additive. Optional ingredients for both systems may include water, glycol ethers, surfactants, builders, fragrances, dyes and optical brighteners. The treatment process for the pre-spotter entails wetting the soiled fabric with the pre-spotter followed by a normal wash operation. The treatment process for the detergent additive would involve exposure of the soiled fabric to the water soluble amine during the wash operation itself without any pre-wash treatment of the fabric.

For a builder, the composition may contain sufficient water-soluble amine to effectively remove blood from fabric. A more preferred level of amine would be 45–55% in the builder. Optional ingredients may include phosphates, silicates, carbonates, bicarbonates, NTA, alkali hydroxides, and other water softening compounds. The treatment process for a builder would involve exposure of the soiled fabric to the water soluble amine during the wash operation itself without any pre-wash treatment of the fabric.

WORKING EXAMPLES

The following examples are non-limiting illustrations of the invention intended to exemplify some of the advantages of the invention.

Working Example 1

A pre-spotter was prepared comprised of 4% laureth/myristeth-7, 2% diethanolamine, and 94% water. This formula was applied to a blood-soiled cloth swatch and allowed to remain on it for 10 minutes. The swatch was then rinsed with water, affording excellent removal of blood from the treated area.

Working Example 2

A detergent additive was prepared comprised of 99.99% diethanolamine and 0.01% protease. This formula was used at a 0.2% level in conjunction with a 0.3% solution of a unbuilt laundry detergent containing nonionic and amphoteric surfactants on a blood-soiled cloth swatch. In its use to wash the soiled cloth at room temperature for 10 minutes, this combination afforded better removal of the blood than achievable with the laundry detergent alone.

Working Example 3

A detergent builder was prepared comprised of 50% diethanolimine, 7% trisodium NTA, 1% polyacrylic acid, 0.65% potassium hydroxide, and 15% sodium silicate. This formula was used as a builder at a 0.2% use level in conjunction with a 0.3% solution of a nonionic/amphoteric surfactant solution. Blood-soiled cloth swatches were washed with this combination for 10 minutes at room temperature, affording better blood removal than with the unbuilt surfactant solution alone.

Working Example 4

Cotton swatches soiled with blood were stirred for 10 minutes at ambient temperature in a 0.5% test solution. This was followed by a 1 minute rinse in cold water and the swatch allowed to air-dry. The dried swatches were then visually scored as follows:

4=complete blood removal

3=good blood removal

2=fair blood removal

1=poor blood removal The results obtained showed that diethanolamine and triethanolamine are superior in blood removal to active chlorine bleach, active oxygen bleach, and protease.

| Solution | Blood Removal |
|---|---|
| chlorine bleach | 4 |
| sodium percarbonate | 3 |
| hydrogen peroxide | 1 |
| protease | 2 |
| diethanolamine | 4 |
| triethanolamine | 4 |

Working Example 5

A cotton swatch soiled with blood was wetted with a 0.5% solution of diethanolamine and allowed to sit for 10 minutes. It was then washed in a detergent solution at ambient temperature followed by a cold water rinse and air-drying. Complete blood removal was obtained.

Working Example 6

Example 6A represents one embodiment of the claimed invention while Example 6B is described in Kawabe. By eliminating water, neutral salt, and hexylene glycol from the formula, a more concentrated, more effective formula prepared, Example 6A. This follows the trend in detergents to concentrate a formula and hence save on packaging and shipping costs.

| | Example 6A | Comparative Example 6B |
|---|---|---|
| diethanolamine | 24.0 | 0.0 |
| laureth-5 | 28.9 | 2.0 |
| laureth-7 | 28.9 | 2.0 |
| sodium lauryl dipropionate | 9.1 | 0.0 |
| 2-butoxyethanol | 9.1 | 0.0 |
| hexylene glycol | 0.0 | 5.0 |

-continued

| | Example 6A | Comparative Example 6B |
|---|---|---|
| sodium chloride | 0.0 | 0.5 |
| fluoresc. dye | 0.0 | 0.1 |
| monoethanolamine | 0.0 | 2.0 |
| water | 0.0 | 88.4 |
| Total: | 100.0 | 100.0 |
| *blood swatch ranking | 4 | 3 |

*Same test method as in Example 4.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

The claimed invention is:

1. A method of removing blood stains from fabric, said method comprising the step of applying a cleaning composition to the fabric, said cleaning composition comprising a detergent additive comprising from about 95 to 99.9 wt-% of an amine compound, and from about 0.1 to 5 wt-% of an enzyme compound wherein said composition is free of neutral salts.

2. The method of claim 1, wherein said amine compound is selected from the group consisting of an alkanol amine, an alkyl amine, a diamine, a cycloaliphatic amine, and mixtures thereof.

3. The method of claim 1, wherein said amine compound comprises an alkanol amine.

4. The method of claim 3, wherein said alkanol amine is selected from the group consisting of monoethanolamine, diethanolamine, triethanolamine, monopropanolamine, dipropanolamine, tripropanolamine, and mixtures thereof.

5. The method of claim 1, wherein said enzyme compound is selected from the group consisting of a protease, an amylase, a cellulase, a lipase, and mixtures thereof.

6. The method of claim 1, wherein said enzyme compound comprises a protease.

7. The method of claim 1, wherein said detergent additive is combined with a detergent in a mixture to provide a cleaning composition which comprises:

a) from about 30 to 70 wt-% of diethanolamine;

b) from about 0.03 to 4 wt-% of a protease; and c) from about 30 to 70 wt-% of a detergent.

8. The method of claim 1, further comprising the step of rinsing the fabric.

9. The method of claim 1, wherein the pH of said cleaning composition ranges from about 8 to 14.

10. The method of claim 7, wherein said composition upon application to said fabric is at a temperature which ranges from about 15° C. to 100° C.

11. A detergent additive composition comprising:

a) at least 95 wt-% amount of an amine compound effective to remove blood from fabric; and b) an effective soil degrading amount of enzyme, wherein said detergent additive composition is solvent-free and free of any neutral salt.

12. The composition of claim 11, wherein said amine compound is selected from the group consisting of an alkanol amine, an alkyl amine, a diamine, a cycloaliphatic amine, and mixtures thereof.

13. The composition of claim 11, wherein said amine compound comprises an alkanol amine.

14. The composition of claim 13, wherein said alkanol amine is selected from the group consisting of monoethanolamine, diethanolamine, triethanol amine, monopropanolamine, dipropanolamine, tripropanolamine, and mixtures thereof.

15. The composition of claim 11, wherein said enzyme compound is selected from the group consisting of a protease, an amylase, a cellulase, a lipase, and mixtures thereof.

16. The composition of claim 11, wherein said enzyme compound comprises a protease.

17. A cleaning composition resulting from a mixture of the detergent additive of claim 11, and a detergent said cleaning composition comprising:

a) from about 30 to 70 wt-% of diethanolamine;

b) from about 0.03 to 4 wt-% of a protease; and c) from about 30 to 70 wt-% of a detergent.

18. A method of removing blood stains from fabric, said method comprising the step of applying a cleaning composition to the fabric, said cleaning composition comprising a detergent builder comprising an effective blood removing amount of amine compound, an effective amount of a chelating agent comprising polyacrylic acid, effective to prevent the formation of precipitates, an amount of alkalinity source effective to provide a compositional pH in said detergent builder of from about 8 to 14, and a balance of water, wherein said detergent builder is free of neutral salt.

19. A method of removing blood stains from fabric, said method comprising the step of applying a cleaning composition to the fabric, said cleaning composition comprising a detergent builder comprising an effective blood removing amount of amine compound, an effective amount of a chelating agent effective to prevent the formation of precipitates, an amount of alkalinity source effective to provide a compositional pH in said detergent builder of from about 8 to 14 comprising a silicate compound, and a balance of water, wherein said detergent builder is free of neutral salt.

20. A method of destaining blood stained fabric using a detergent builder comprising an effective blood removing amount of amine compound, an amount of chelating agent effective to prevent the formation of precipitates, an amount of alkalinity source effective to provide a compositional pH in said detergent builder of from about 8 to 14, and a balance of water, wherein said detergent builder is free of neutral salt, said method comprising the steps of:

a) combining said detergent builder with a detergent to form a cleaning composition; and b) applying said cleaning composition to the bloodstained fabric, wherein said cleaning composition comprises;

a) from about 10 to 50 wt-% of diethanolamine;

b) from about 0.1 to 5 wt-% of potassium hydroxide;

c) from about 0.1 to 5 wt-% of polyacrylic acid;

d) from about 5 to 10 wt-% of a silicate compound;

e) from about 30 to 85 wt-% of water;

f) from about 2 to 6 wt-% of trisodium nitriloacetate; and g) from about 30 to 70 wt-% of a detergent.

21. The method of claim 20, further comprising the step of rinsing the fabric.

* * * * *